US010612121B2

(12) United States Patent
Lee et al.

(10) Patent No.: US 10,612,121 B2
(45) Date of Patent: Apr. 7, 2020

(54) PLASMA RESISTANT COATING WITH TAILORABLE COEFFICIENT OF THERMAL EXPANSION

(71) Applicant: Applied Materials, Inc., Santa Clara, CA (US)

(72) Inventors: Chengtsin Lee, Union City, CA (US); Jennifer Y. Sun, Mountain View, CA (US)

(73) Assignee: Applied Materials, Inc., Santa Clara, CA (US)

( * ) Notice: Subject to any disclaimer, the term of this patent is extended or adjusted under 35 U.S.C. 154(b) by 469 days.

(21) Appl. No.: 15/418,598

(22) Filed: Jan. 27, 2017

(65) Prior Publication Data

US 2017/0260616 A1 Sep. 14, 2017

Related U.S. Application Data

(60) Provisional application No. 62/307,688, filed on Mar. 14, 2016.

(51) Int. Cl.

| | |
|---|---|
| ***B32B 3/10*** | (2006.01) |
| ***C23C 4/134*** | (2016.01) |
| ***C23C 4/04*** | (2006.01) |

(52) U.S. Cl.

CPC ..... *C23C 4/134* (2016.01); *C23C 4/04* (2013.01)

(58) Field of Classification Search

None

See application file for complete search history.

(56) References Cited

U.S. PATENT DOCUMENTS 5,043,305 A * 8/1991 Tanaka ..... C04B 35/111 501/103
5,224,017 A 6/1993 Martin
7,824,763 B2 11/2010 Namburi et al.

FOREIGN PATENT DOCUMENTS

EP 0225781 B1 9/1991

OTHER PUBLICATIONS

Greve, B.K., "Exploring the Thermal Expansion of Flourides and Oxyflourides with ReO3-Type Structures: From Negative to Positive Thermal Expansion," Doctoral Thesis, Georgia Institute of Technology, Dec. 19, 2011, 118 pages.

* cited by examiner

*Primary Examiner* — Christopher M Polley
(74) *Attorney, Agent, or Firm* — Lowenstein Sandler LLP

(57) ABSTRACT

An article comprises a body and at least one final plasma resistant coating layer on at least one surface of the body. The at least one final plasma resistant coating layer is a mixture of a $ScF_3$ and an initial plasma resistant coating material selected from the group consisting of $YF_3$, $Y_2O_3$, a compound of $Y_4Al_2O_9$, a solid-solution of $Y_2O_3$—$ZrO_2$, $CaF_2$, $MgF_2$, $SrF_2$, $AlF_3$, $ErF_3$, $LaF_3$, $NdF_3$, $ScF_3$, $CeF_4$, $ZrF_4$, and combinations thereof. The at least one final plasma resistant coating layer has a thermal expansion coefficient that is within about 20% of the thermal expansion coefficient of the body.

20 Claims, 6 Drawing Sheets

PLASMA RESISTANT COATING WITH TAILORABLE COEFFICIENT OF THERMAL EXPANSION

RELATED APPLICATIONS

This patent application claims the benefit under 35 U.S.C. § 119(e) of U.S. Provisional Application No. 62/307,688, filed Mar. 14, 2016, which is herein incorporated by reference.

TECHNICAL FIELD

Embodiments of the present disclosure relate, in general, to a method for creating a plasma resistant coating material with a tailored Coefficient of Thermal Expansion (CTE), to the plasma resistant coating material, and to an article coated with the plasma resistant coating material.

BACKGROUND

Various manufacturing processes expose chamber components and their coating materials to high temperatures, high energy plasma, a mixture of corrosive gases, high stress, and combinations thereof. These extreme conditions may increase the components' and the coating materials' susceptibility to defects. It is desirable to reduce these defects. Pressure and/or stress management is an effective way to reduce particle defects and improve coating integrity. For example, exposure of a components' coating to compressive forces improves the coating's integrity and reduces defect. Conversely, mismatch in CTEs of adjacent materials may expose the components' coatings to tensile forces which increase the coatings' susceptibility to cracking.

SUMMARY

Some embodiments of the present invention cover a coated article that includes a body having a CTE and a final plasma resistant coating material having a CTE tailored to the CTE of the body. Other embodiments of the present invention cover a final plasma resistant coating material for a component of chamber manufacturing equipment. Yet other embodiments of the present invention cover a method for preparing a final plasma resistant coating material for a component of chamber manufacturing equipment.

In one embodiment, the method includes identifying a CTE of a component for a chamber of manufacturing equipment. The method further includes identifying the CTE of an initial plasma resistant coating material to be used for coating a surface of the component. The method further includes confirming that the CTE of the initial plasma resistant coating material is greater than the CTE of the component. The method further includes mixing the initial plasma resistant coating material with a plasma resistant coating material having a negative CTE, such as $ScF_3$, to form a final plasma resistant coating material having a tailored CTE. In some embodiments, the tailored CTE of the final plasma resistant coating material is within 20% of the CTE of the component. In some embodiments, the method may further include coating the surface of the component with the final plasma resistant coating material.

In one embodiment, the final plasma resistant coating material may comprise a first amount of an initial plasma resistant coating material having a CTE that is higher from the CTE of the body to be coated. The final plasma resistant coating material may also comprise a second amount of a plasma resistant coating material having a negative CTE, such as $ScF_3$. In some embodiments, the first amount of the initial plasma resistant coating material and the second amount of the ScF3 causes the tailored CTE of the final plasma resistant coating material to be within 20% of the CTE of the bare component. In some embodiments, the final plasma resistant coating material may be a solid solution of the initial plasma resistant coating material and $ScF_3$.

In some embodiments, the initial plasma resistant coating material may be selected from the group consisting of $YF_3$, $Y_2O_3$, a compound of $Y_4Al_2O_9$, a solid-solution of $Y_2O_3$—$ZrO_2$, $CaF_2$, $MgF_2$, $SrF_2$, $AlF_3$, $ErF_3$, $LaF_3$, $NdF_3$, $ScF_3$, $CeF_4$, $ZrF_4$, and combinations thereof. In some embodiments, the component and/or the body to be coated comprise one or more of Si, $SiO_2$, SiC, AlN, or $Al_2O_3$.

BRIEF DESCRIPTION OF THE DRAWINGS

The present disclosure is illustrated by way of example, and not by way of limitation, in the figures of the accompanying drawings in which like references indicate similar elements. It should be noted that different references to "an" or "one" embodiment in this disclosure are not necessarily to the same embodiment, and such references mean at least one.

DETAILED DESCRIPTION OF EMBODIMENTS

Figure 1:
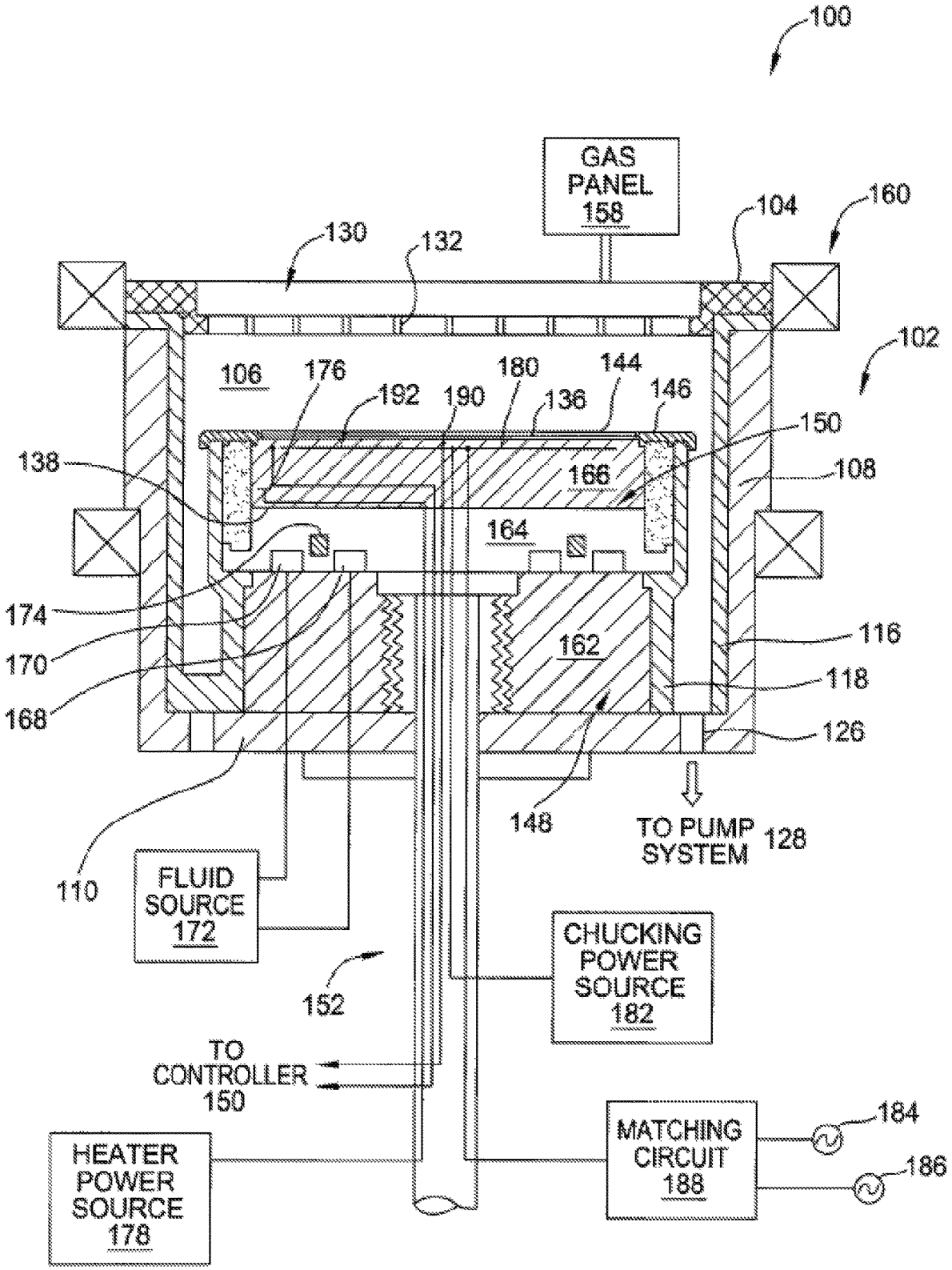
FIG. 1 depicts a sectional view of one embodiment of a processing chamber.

"Plasma resistant coating material" refers to a material that is resistant to erosion and corrosion due to exposure to plasma processing conditions. The plasma processing conditions include a plasma generated from halogen-containing gases, such as $C_2F_6$, $SF_6$, $SiCl_4$, HBR, $NF_3$, $CF_4$, $CHF_3$, $CH_2F_3$, F, $NF_3$, $Cl_2$, $CCl_4$, $BCl_3$ and $SiF_4$, among others, and other gases such as $O_2$, or $N_2O$. The resistance of the coating material to plasma is measured through "etch rate" (ER), which may have units of Angstrom/min (Å/min), throughout the duration of the coated components' operation and exposure to plasma. Plasma resistance may also be measured through an erosion rate having the units of nanometer/radio frequency hour (nm/RFHr), where one RFHr represents one hour of processing in plasma processing conditions. Measurements may be taken after different processing times. For example, measurements may be taken before processing, after 50 processing hours, after 150 processing hours, after 200 processing hours, and so on. An erosion rate lower than about 100 nm/RFHr is typical for a plasma resistant coating material. A single plasma resistant material may have multiple different plasma resistance or erosion rate values. For example, a plasma resistant material may have a first plasma resistance or erosion rate associated with a first type of plasma and a second plasma resistance or erosion rate associated with a second type of plasma.

It is possible to tailor the CTE of a chosen plasma resistant coating material to match the CTE of the various chamber components that are to be coated. Reduction in the CTE mismatch will reduce tensile forces exerted on the coating material during temperature variations. A material having a negative CTE, such as $ScF_3$, may be mixed with a typical plasma resistant coating material having a CTE that is greater than that of the chamber component's CTE. The mixed material may comprise a reduced CTE tailored to match the CTE of chamber component, while maintaining the desirable plasma resistant properties of the typical plasma resistant coating material.

Embodiments of the present invention provide an article such as a chamber component for a processing chamber having a plasma resistant coating layer on one or more surfaces of the article. The plasma resistant coating layer may be coated on the article using various techniques, such as plasma spraying techniques, thermal spraying techniques such as detonation spraying, wire arc spraying, high velocity fuel (HVOF) spraying, flame spraying, warm spraying and cold spraying, aerosol deposition, e-beam evaporation, electroplating, ion assisted deposition (IAD), physical vapor deposition (PVD), chemical vapor deposition (CVD), and plasma assisted deposition. The plasma resistant coating layer may be a solid solution mixture of $ScF_3$ and one or more other materials. Some other materials that may be combined with the $ScF_3$ to form the solid solution mixture include $YF_3$, $Y_2O_3$, a compound of $Y_4Al_2O_9$, a solid-solution of $Y_2O_3$—$ZrO_2$, $CaF_2$, $MgF_2$, $SrF_2$, $AlF_3$, $ErF_3$, $LaF_3$, $NdF_3$, $ScF_3$, $CeF_4$, $ZrF_4$, and combinations thereof. The improved erosion resistance and CTE compatibility of the plasma resistant coating material with the article that is coated may improve the service life of the article, while reducing maintenance and manufacturing cost.

FIG. 1 is a sectional view of a semiconductor processing chamber 100 having one or more chamber components that are coated with a plasma resistant coating layer in accordance with embodiments of the present invention. The processing chamber 100 may be used for processes in which a corrosive plasma environment having plasma processing conditions is provided. For example, the processing chamber 100 may be a chamber for a plasma etcher or plasma etch reactor, a plasma cleaner, and so forth. Examples of chamber components that may include a plasma resistant coating layer include a substrate support assembly 148, an electrostatic chuck (ESC) 150, a ring (e.g., a process kit ring or single ring), a chamber wall, a base, a gas distribution plate, a showerhead, a nozzle, a lid, a liner, a liner kit, a shield, a plasma screen, a flow equalizer, a cooling base, a chamber viewport, a chamber lid, and so on. The plasma resistant coating layer, which is described in greater detail below, may include a solid solution mixture of varying portions of $ScF_3$ and $YF_3$, $Y_2O_3$, a compound of $Y_4Al_2O_9$, a solid-solution of $Y_2O_3$—$ZrO_2$, $CaF_2$, $MgF_2$, $SrF_2$, $AlF_3$, $ErF_3$, $LaF_3$, $NdF_3$, $ScF_3$, $CeF_4$, $ZrF_4$, or combinations thereof.

The plasma resistant coating layer may be coated by various techniques over different ceramics including oxide based ceramics, nitride based ceramics and carbide based ceramics. Examples of oxide based ceramics include $SiO_2$ (quartz), $Al_2O_3$, $Y_2O_3$, $Y_4Al_2O_9$, $Y_2O_3$—$ZrO_2$ and so on. Examples of carbide based ceramics include SiC, Si—SiC, and so on. Examples of nitride based ceramics include AlN, SiN, and so on.

As illustrated, the substrate support assembly 148 has a plasma resistant coating layer 136, in accordance with one embodiment. However, it should be understood that any of the other chamber components, such as those listed above, may also include a plasma resistant coating layer.

In one embodiment, the processing chamber 100 includes a chamber body 102 and a showerhead 130 that enclose an interior volume 106. The showerhead may include a showerhead base and a showerhead gas distribution plate. Alternatively, the showerhead 130 may be replaced by a lid and a nozzle in some embodiments. The chamber body 102 may be fabricated from aluminum, stainless steel or other suitable material. The chamber body 102 generally includes sidewalls 108 and a bottom 110. Any of the showerhead 130 (or lid and/or nozzle), sidewalls 108 and/or bottom 110 may include a plasma resistant coating layer.

An outer liner 116 may be disposed adjacent the sidewalls 108 to protect the chamber body 102. The outer liner 116 may be fabricated and/or coated with a plasma resistant coating layer. In one embodiment, the outer liner 116 is fabricated from aluminum oxide.

An exhaust port 126 may be defined in the chamber body 102, and may couple the interior volume 106 to a pump system 128. The pump system 128 may include one or more pumps and throttle valves utilized to evacuate and regulate the pressure of the interior volume 106 of the processing chamber 100.

The showerhead 130 may be supported on the sidewall 108 of the chamber body 102. The showerhead 130 (or lid) may be opened to allow access to the interior volume 106 of the processing chamber 100, and may provide a seal for the processing chamber 100 while closed. A gas panel 158 may be coupled to the processing chamber 100 to provide process and/or cleaning gases to the interior volume 106 through the showerhead 130 or lid and nozzle. Showerhead 130 is used for processing chambers used for dielectric etch (etching of dielectric materials). The showerhead 130 includes a gas distribution plate (GDP) 133 having multiple gas delivery holes 132 throughout the GDP 133. The showerhead 130 may include the GDP 133 bonded to an aluminum base or an anodized aluminum base. The GDP 133 may be made from Si or SiC, or may be a ceramic such as $Y_2O_3$, $Al_2O_3$, YAG, and so forth.

For processing chambers used for conductor etch (etching of conductive materials), a lid may be used rather than a showerhead. The lid may include a center nozzle that fits into a center hole of the lid. The lid may be a ceramic such as $Al_2O_3$, $Y_2O_3$, YAG, or a ceramic compound comprising $Y_4Al_2O_9$ and a solid-solution of $Y_2O_3$—$ZrO_2$. The nozzle may also be a ceramic, such as $Y_2O_3$, YAG, or the ceramic compound comprising $Y_4Al_2O_9$ and a solid-solution of $Y_2O_3$—$ZrO_2$. The lid, showerhead base 104, GDP 133 and/or nozzle may be coated with a plasma resistant coating layer according to an embodiment.

Examples of processing gases that may be used to process substrates in the processing chamber 100 include halogen-containing gases, such as $C_2F_6$, $SF_6$, $SiCl_4$, HBr, $NF_3$, $CF_4$, $CHF_3$, $CH_2F_3$, F, $NF_3$, $Cl_2$, $CCl_4$, $BCl_3$ and $SiF_4$, among others, and other gases such as $O_2$, or $N_2O$. Examples of carrier gases include $N_2$, He, Ar, and other gases inert to process gases (e.g., non-reactive gases). The substrate support assembly 148 is disposed in the interior volume 106 of the processing chamber 100 below the showerhead 130 or lid. The substrate support assembly 148 holds the substrate 144 during processing. A ring 146 (e.g., a single ring) may cover a portion of the electrostatic chuck 150, and may protect the covered portion from exposure to plasma during processing. The ring 146 may be silicon or quartz in one embodiment.

An inner liner 118 may be coated on the periphery of the substrate support assembly 148. The inner liner 118 may be a halogen-containing gas resist material such as those discussed with reference to the outer liner 116. In one embodiment, the inner liner 118 may be fabricated from the same materials of the outer liner 116. Additionally, the inner liner 118 may be coated with a plasma resistant coating layer.

In one embodiment, the substrate support assembly 148 includes a mounting plate 162 supporting a pedestal 152, and an electrostatic chuck 150. The electrostatic chuck 150 further includes a thermally conductive base 164 and an electrostatic puck 166 bonded to the thermally conductive base by a bond 138, which may be a silicone bond in one embodiment. An upper surface of the electrostatic puck 166 is covered by the plasma resistant coating layer 136 in the illustrated embodiment. In one embodiment, the plasma resistant coating layer 136 is disposed on the upper surface of the electrostatic puck 166. In another embodiment, the plasma resistant coating layer 136 is disposed on the entire exposed surface of the electrostatic chuck 150 including the outer and side periphery of the thermally conductive base 164 and the electrostatic puck 166. The mounting plate 162 is coupled to the bottom 110 of the chamber body 102 and includes passages for routing utilities (e.g., fluids, power lines, sensor leads, etc.) to the thermally conductive base 164 and the electrostatic puck 166.

The thermally conductive base 164 and/or electrostatic puck 166 may include one or more optional embedded heating elements 176, embedded thermal isolators 174 and/or conduits 168, 170 to control a lateral temperature profile of the substrate support assembly 148. The conduits 168, 170 may be fluidly coupled to a fluid source 172 that circulates a temperature regulating fluid through the conduits 168, 170. The embedded isolator 174 may be disposed between the conduits 168, 170 in one embodiment. The heater 176 is regulated by a heater power source 178. The conduits 168, 170 and heater 176 may be utilized to control the temperature of the thermally conductive base 164. The conduits and heater heat and/or cool the electrostatic puck 166 and a substrate (e.g., a wafer) 144 being processed. The temperature of the electrostatic puck 166 and the thermally conductive base 164 may be monitored using a plurality of temperature sensors 190, 192, which may be monitored using a controller 195.

The electrostatic puck 166 may further include multiple gas passages such as grooves, mesas and other surface features, that may be formed in an upper surface of the puck 166 and/or the plasma resistant coating layer 136. The gas passages may be fluidly coupled to a source of a heat transfer (or backside) gas such as He via holes drilled in the puck 166. In operation, the backside gas may be provided at controlled pressure into the gas passages to enhance the heat transfer between the electrostatic puck 166 and the substrate 144.

The electrostatic puck 166 includes at least one clamping electrode 180 controlled by a chucking power source 182. The electrode 180 (or other electrode disposed in the puck 166 or base 164) may further be coupled to one or more RF power sources 184, 186 through a matching circuit 188 for maintaining a plasma formed from process and/or other gases within the processing chamber 100. The sources 184, 186 are generally capable of producing RF signal having a frequency from about 50 kHz to about 3 GHz and a power of up to about 10,000 Watts.

Figure 2A:
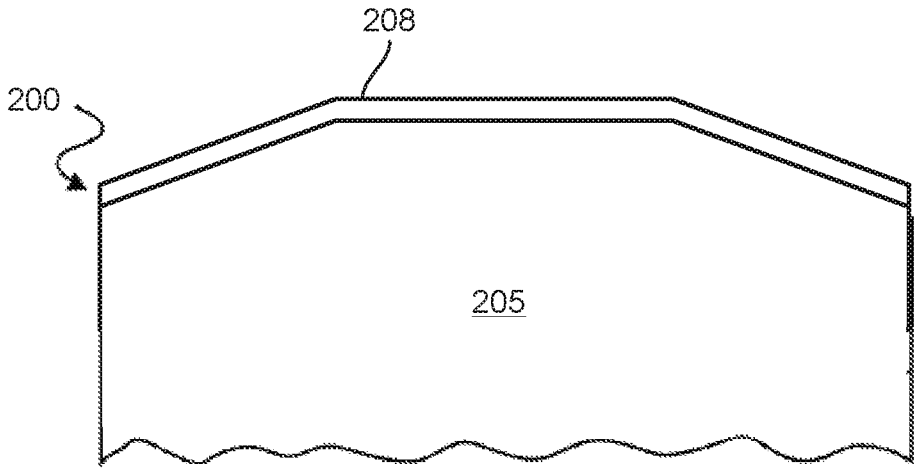
FIGS. 2A-2C depict sectional views of exemplary chamber components with various coatings according to various embodiments.
Figure 2B:
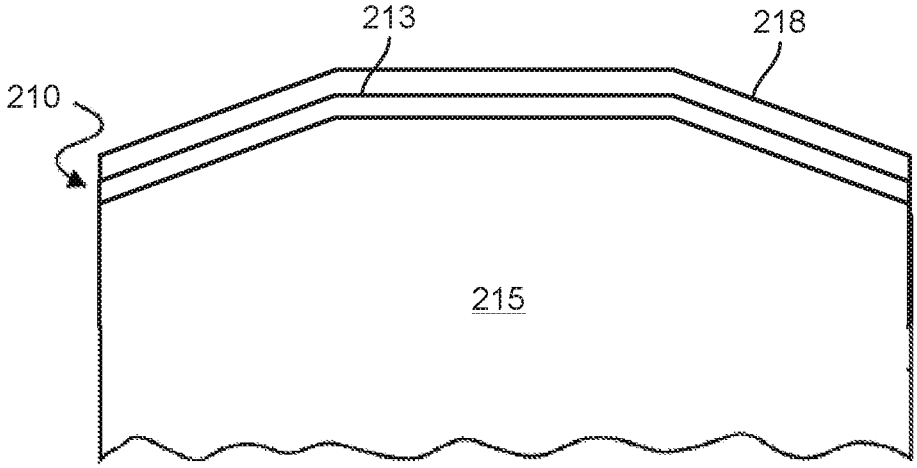
Figure 2C:
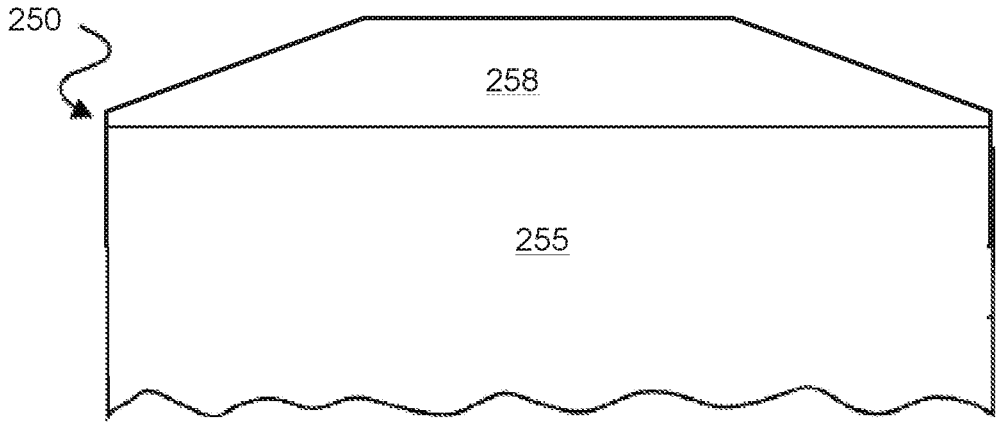

FIGS. 2A-2C depict sectional views of exemplary coated articles according to various embodiments. FIG. 2A illustrates a coated article 200 having a body 205 and a single coat of a plasma resistant coating layer 208. The body 205 may comprise various chamber components including but not limited to substrate support assembly, an electrostatic chuck (ESC), a ring (e.g., a process kit ring or single ring), a chamber wall, a base, a gas distribution plate, a showerhead, a nozzle, a lid, a liner, a liner kit, a shield, a plasma screen, a flow equalizer, a cooling base, a chamber viewport, a chamber lid, and so on. The body may be made from a metal (such as aluminum, stainless steel), a ceramic, a metal-ceramic composite, a polymer, a polymer ceramic composite, or other suitable materials, and may further comprise materials such as AlN, Si, SiC, $Al_2O_3$, $SiO_2$, and so on.

The plasma resistant coating layer 208 may be coated on the body through various techniques depending on the chosen application and coating properties. Some of the coating techniques may be plasma spraying techniques, thermal spraying techniques such as detonation spraying, wire arc spraying, high velocity fuel (HVOF) spraying, flame spraying, warm spraying and cold spraying, aerosol deposition, e-beam evaporation, electroplating, ion assisted deposition (IAD), physical vapor deposition (PVD), chemical vapor deposition (CVD), and plasma assisted deposition.

The plasma resistant coating layer 208 coated onto the body 205 will be referred to herein as the final plasma resistant coating material. The final plasma resistant coating material may comprise a first amount of an initial plasma resistant coating material and a second amount of $ScF_3$. The initial plasma resistant coating material may be selected from the group consisting of $YF_3$, $Y_2O_3$, a compound of $Y_4Al_2O_9$, a solid-solution of $Y_2O_3$—$ZrO_2$, $CaF_2$, $MgF_2$, $SrF_2$, $AlF_3$, $ErF_3$, $LaF_3$, $NdF_3$, $ScF_3$, $CeF_4$, $ZrF_4$, and combinations thereof.

Due to the mismatch of thermal expansion coefficients between the initial plasma resistant coating materials and the body or chamber component to be coated, a coating applied at room temperature is highly susceptible to cracking during an etch process. Additionally, a coating applied at higher temperatures may also be susceptible to cracking. This is because the materials of construction of the chamber component will expand at a greater rate than the initial plasma resistant coating material during heating, causing a tension force that forms cracks, delamination and other deformities in the coating. Deposition temperatures may be higher than room temperature in some embodiments due to inherent heating of plasma and/or due to external heating (e.g., using a heating element) and occasionally for improved adhesion and film properties. Temperature differentials, such as heating and cooling, accentuate the incompatibility between CTEs of adjacent materials. The greater the mismatch in the CTE between two adjacent materials, the greater the likelihood that one of those materials will eventually crack, peel away, or otherwise lose its bond to the other material.

The final plasma resistant coating material 208 may be formed in such a way to minimize the mismatch of the CTE between adjacent materials (body and coating). Mixing a first amount of the initial plasma resistant coating material and a second amount of the $ScF_3$ allow tailoring the CTE of the final plasma resistant coating material to be within about 20% of the CTE of the body. In some embodiments, mixing a first amount of the initial plasma resistant coating material and a second amount of the $ScF_3$ allow tailoring the CTE of the final plasma resistant coating material to be within about 15%, about 10%, about 5%, about 2%, or about 1% of the CTE of the body.

The CTE of the final plasma resistant coating 208 may be tailored based on the individual CTEs of the constituent materials in the final plasma resistant coating 208 and the percentages of those constituent materials. Most materials expand as temperature goes up (have a positive CTE). However, $ScF_3$ has a property that causes $ScF_3$ to contract as temperature goes up (has a negative CTE) within a certain temperature range. Accordingly, the more $ScF_3$ that is used in the final plasma resistant coating 208, the lower the CTE for that final plasma resistant coating 208 will be. The CTE for the final plasma resistant coating 208 may be determined based on comparing a CTE of the component to be coated to a CTE of an initial coating material. The CTE of the component may be a target CTE for the final plasma resistant coating. A CTE for the final plasma resistant coating 208 may then be computed according to the following formula:

$$x*n+y*m=z$$

where x is the CTE of $ScF_3$, n is the volume percentage of $ScF_3$ in the final plasma resistant coating 208, y is the CTE of the additional ceramic material that is combined with $ScF_3$ to form the solid solution, m is the volume percentage of the additional ceramic material, and z is the CTE of the component to be coated. The known CTEs of the different materials to be used may be inserted into the formula to solve for the percentages of the $ScF_3$ and the additional material to use.

FIG. 2B illustrates a coated article 210 having a body 215, a first coat 213 deposited onto the body, and a second coat 218 deposited onto the first coat 213. In some embodiments, both coats 213 and 218 may be deposited using standard deposition techniques such as those discussed above. In certain embodiments, both coats are deposited using the same technique. In other embodiments, each coat may be independently deposited using different techniques. In some embodiments, both coats 213 and 218 may have the same composition. In other embodiments, the compositions of the coats may be different. In some embodiments, both coats 213 and 218 may have similar properties such as thickness, porosity, plasma resistance, CTE. In other embodiments, each coat may have different properties. It is to be understood that although FIG. 2B depicts two coats, the Figure is not intended to be limiting, and additional coats may be deposited onto the body in certain embodiments. In some embodiments, the entire surface of a body may be coated. In other embodiments, at least a portion of the body's surface may be coated.

In some embodiments, the first coat 213 is a solid solution that includes a first ceramic (e.g., $YF_3$, $Y_2O_3$, a compound of $Y_4Al_2O_9$, a solid-solution of $Y_2O_3$—$ZrO_2$, $CaF_2$, $MgF_2$, $SrF_2$, $AlF_3$, $ErF_3$, $LaF_3$, $NdF_3$, $ScF_3$, $CeF_4$, $ZrF_4$) and $ScF_3$, and the second coat 218 is a coating of just the first ceramic. The first coat 213 may have a CTE that is between the CTE of the body 215 and the CTE of the second coat 218, and may minimize cracking and particle generation caused by thermal mismatch.

In some embodiments, the final plasma resistant coating material may be a thin film. In some embodiments, the coated article may comprise several layers of final plasma resistant coating material forming thin film stacks. Each thin film plasma resistant coating material layer may have a thickness of less than approximately 20 micrometers, and less than approximately 10 micrometers in some embodiments. Thin film coatings may be advantageous for improved chamber performance in some embodiments due to their dense and defect free characteristics. In some embodiments, the advantages of thin film coatings on chamber performance may be further improved by decreasing the CTE mismatch between the article coated and the thin film coating.

FIG. 2C illustrates a coated article 220 having a body 225 and a coat 258 deposited onto the body 225. In some embodiments, the final plasma resistant coating material coat 258 may be a thick film deposited with a suitable deposition technique such as a plasma spray technique. A non-limiting example of a chamber component article that may be coated with a thick film may be a lid for a plasma etcher used for conductor etch processes. Such a lid may comprise sintered ceramic, such as $Al_2O_3$. Upon exposure of $Al_2O_3$ to Fluorine chemistry, ALF particles and aluminum metal contaminants are formed. To reduce particle generation and metal contamination and to prolong the life of the lid, a thick film of a final plasma resistant coating material with a tailored CTE may be used. Any other components discussed herein may also be coated with a thick film.

Figure 3:
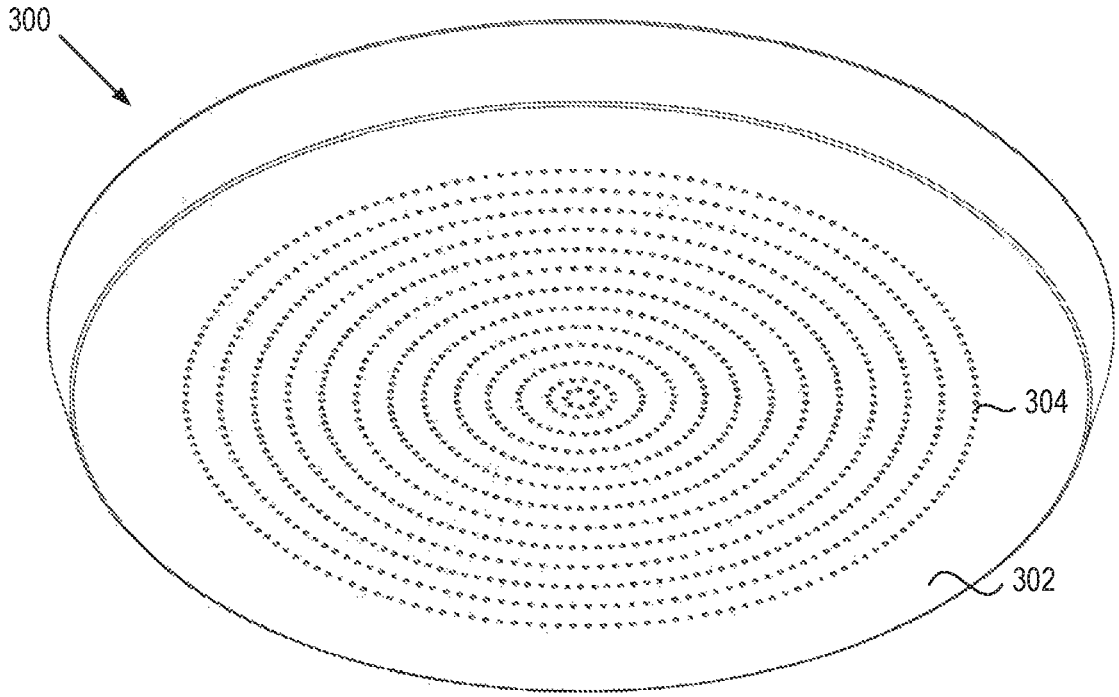
FIG. 3 depicts a bottom view of a coated showerhead according to an embodiment.

FIG. 3 illustrates a bottom view of a showerhead 300. The showerhead example provided below is just an exemplary chamber component whose performance may be improved by the use of the final plasma resistant coating layer as set forth in embodiments herein. It is to be understood that the performance of other chamber components may also be improved when coated with the final plasma resistant coating layer disclosed herein. The showerhead 300, as depicted here, is formed having a lower surface 302 configured to receive a final plasma resistant coating layer.

Showerhead 300 may be made of anodized aluminum bonded to a SiC faceplate. The SiC faceplate may be bonded to lower surface 302. The final plasma resistant material may then be coated onto the faceplate. When such a showerhead is exposed to chemistries including fluorine, AlF may form due to plasma interaction with the anodized aluminum base. A plasma resistant coating material may reduce such plasma interactions and improve the showerhead's durability.

Lower surface 302 of showerhead 300 defines gas conduits 304 arranged in evenly distributed concentric rings. In other embodiments, gas conduits 304 may be configured in alternative geometric configurations and may have as many or as few gas conduits as needed depending on the type of reactor and/or process utilized. The final plasma resistant coating layer maintains a relative shape and geometric configuration of the lower surface 302 and of the gas conduits 304 so as to not disturb the functionality of the showerhead. The final plasma resistant coating layer may also be thin enough so as to not plug the gas conduits in the showerhead. Similarly, when applied to other chamber components, the final plasma resistant coating material may maintain the shape and geometric configuration of the surface it is intended to coat so as to not disturb the component's functionality.

Figure 4:
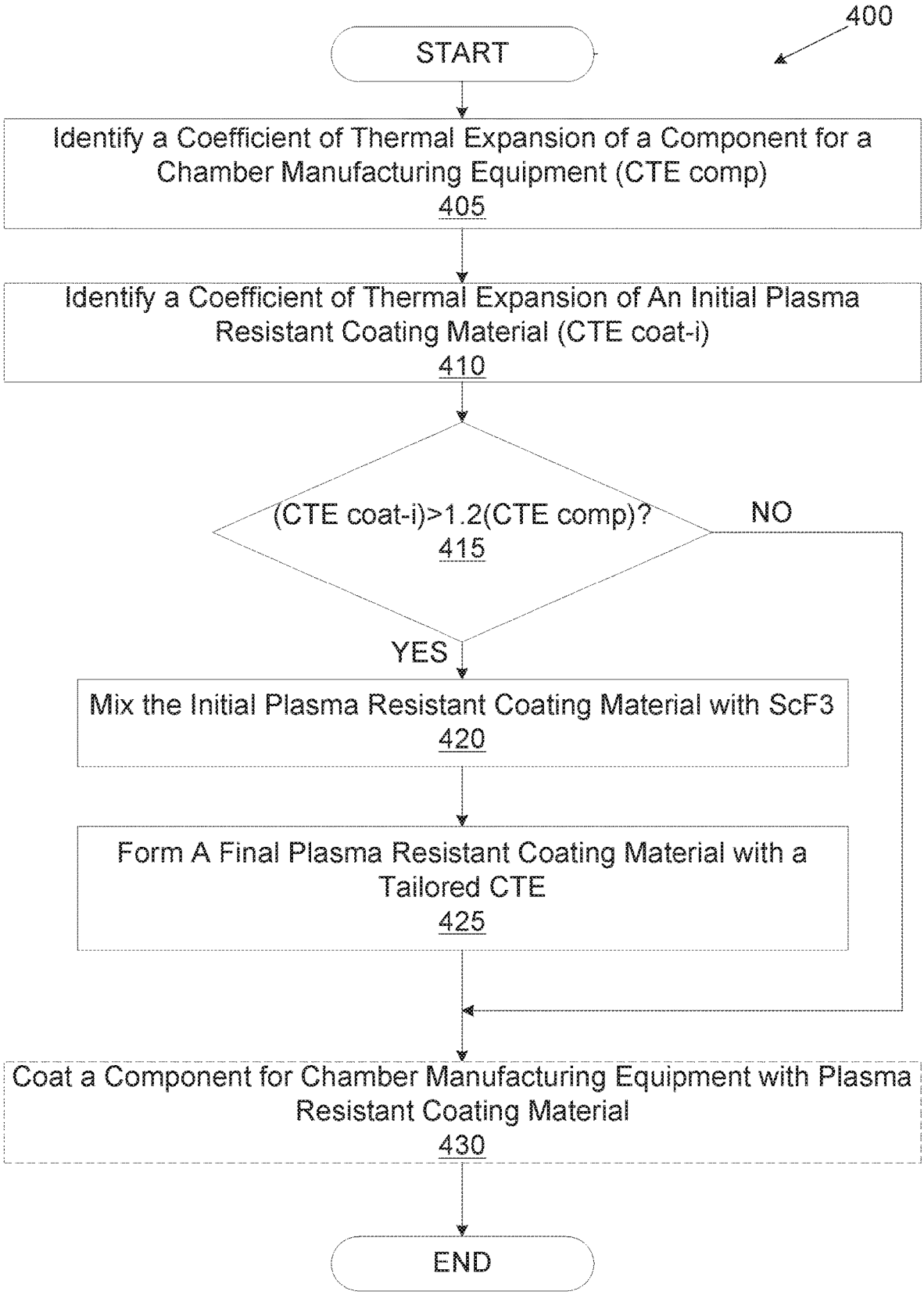
FIG. 4 illustrates a process for manufacturing a plasma resistant coating material according to an embodiment.

FIG. 4 illustrates a process 400 for manufacturing a plasma resistant coating material according to an embodiment. At block 405 of process 400, the CTE of a component for a chamber of manufacturing equipment is identified. At block 410, the CTE of a chosen initial plasma resistant coating material is identified. At block 415, a determination is made of whether or not the CTE of the initial plasma resistant coating material is at least 20% greater than the CTE of the component for chamber manufacturing equipment. If the CTE of the initial plasma resistant coating material is at least 20% greater than the CTE of the component for chamber manufacturing equipment, the method proceeds to block 420. Otherwise, the method continues to optional block 430 or to the end of the process.

At block 420, the initial plasma resistant coating material is mixed with $ScF_3$, a plasma resistant material characterized by a negative CTE of about −7 ppm/K near room temperature. $ScF_3$ shows strong negative thermal expansion of about −14 ppm/K at low temperature such as 60-110 K. Its CTE gradually increases upon heating. $ScF_3$ maintains its negative CTE property up to a temperature of 1100 K, at which point its CTE gradually shifts to positive. $ScF_3$ has additional beneficial properties besides its negative CTE property, making it particularly suitable for coating application of various chamber components that tend to be exposed to extreme processing conditions. $ScF_3$ is also a rare earth fluoride with a high melting temperature (about 1552° C.), and has good chemical resistance in fluorine chemistry—a common plasma environment that various chamber components are exposed to during processing.

Mixing the initial plasma resistant coating material with $ScF_3$ may be performed by various methods. For example, ceramic particles of the constituents may be ball milled together followed by calcination. Ball milling followed by calcination may form a solid solution. The physical properties of the solid solution may be altered. If the $ScF_3$ constituent is chemically inert with respect to the other constituents and does not chemically react with any of them, then the alterations to physical properties, such as the CTE, could be mathematically estimated. The mixing may be performed first to form the final plasma resistant coating material, which may then be coated onto a component. Alternatively, in some embodiments, the mixing may occur during the coating of the component.

At block 425, a final plasma resistant coating material is formed. The final plasma resistant coating material may be characterized with a tailored CTE that is within about 20%, about 15%, about 10%, about 5%, about 2%, or about 1% of the CTE of the component for chamber manufacturing equipment.

The CTE of the final plasma resistant coating material is tailored by adjusting the amount of the initial plasma resistant coating material and the amount of the $ScF_3$ proportionally to their corresponding CTE values. For example, in one embodiment, 50 vol % of initial plasma resistant material $YF_3$ (having a CTE of 14 ppm/K) may be physically mixed with 50 vol % of $ScF_3$ (having a CTE of −7 ppm/K) to form a final plasma resistant material having a tailored CTE of 3.5 ppm/K which is close to the CTE of AlN, Si, or SiC. In another embodiment, 65 vol % of initial plasma resistant material $YF_3$ (having a CTE of 14 ppm/K) may be physically mixed with 35 vol % of $ScF_3$ (having a CTE of −7 ppm/K) to form a final plasma resistant material having a tailored CTE of 6.5 ppm/K which is close to the CTE of alumina. In yet another embodiment, 60 vol % of initial plasma resistant material $Y_2O_3$ (having a CTE of 6 ppm/K) may be physically mixed with 40 vol % of $ScF_3$ (having a CTE of −7 ppm/K) to form a final plasma resistant material having a tailored CTE of 0.8 ppm/K which is close to the CTE of quartz.

The above exemplary embodiments should not be construed limiting. Various CTEs may be obtained by combining a variety of materials. The proportions and final CTE values may be calculated pursuant to formulas I, II, and III below.

$$CTE_{coat-f} = \left(\frac{V_{coat-i}}{100}\right) * CTE_{coat-i} + \left(\frac{V_{ScF_3}}{100}\right) * CTE_{ScF_3} \quad \text{Formula I}$$

-continued $$CTE_{coat-i} = \left(\frac{V_1}{100}\right) * CTE_1 + \ldots + \left(\frac{V_n}{100}\right) * CTE_n \quad \text{Formula II}$$

$$V_{coat-i} = V_1 + \ldots + V_n \quad \text{Formula III}$$

Where n may be 1, 2, 3, 4, or 5.

Where $V_1$ represents the volume of a first material of the chosen initial plasma resistant material, $V_n$ represents the volume of the n material of the chosen initial plasma resistant material, and $V_{ScF3}$ represents the volume of $ScF_3$.

Where $CTE_1$ represents the CTE of a first material of the chosen initial plasma resistant material, $CTE_n$ represents the CTE of the n material of the chosen initial plasma resistant material, and $CTE_{ScF3}$ represents the CTE of $ScF_3$.

The materials comprising the initial plasma resistant material may be selected from a group consisting of $YF_3$, $Y_2O_3$, a compound of $Y_4Al_2O_9$, a solid-solution of $Y_2O_3$—$ZrO_2$, $CaF_2$, $MgF_2$, $SrF_2$, $AlF_3$, $ErF_3$, $LaF_3$, $NdF_3$, $ScF_3$, $CeF_4$, $ZrF_4$, and combinations thereof.

Once a final plasma resistant coating material is formed, the method may continue to optional block 430. In block 430 the component for chamber manufacturing equipment is coated with the plasma resistant coating material. The coating may be performed by the same individual who formed the final plasma resistant coating material. Alternatively, the plasma resistant coating material may be provided to a third party that may then independently coat the article and/or chamber component of interest.

The plasma resistant coating layer may be coated on the article using various techniques, some of which are discussed below in detail. The various coating techniques include but are not limited to plasma spraying techniques, thermal spraying techniques such as detonation spraying, wire arc spraying, high velocity fuel (HVOF) spraying, flame spraying, warm spraying and cold spraying, aerosol deposition, e-beam evaporation, electroplating, ion assisted deposition (IAD), physical vapor deposition (PVD), chemical vapor deposition (CVD), and plasma assisted deposition. For example, if IAD is selected as the coating technique, two separate targets may be utilized. One target may be $ScF_3$ and the other target may be the other constituents of the initial plasma resistant coating material. Both targets together may form the final plasma resistant coating material deposited on the component.

Figure 5A:
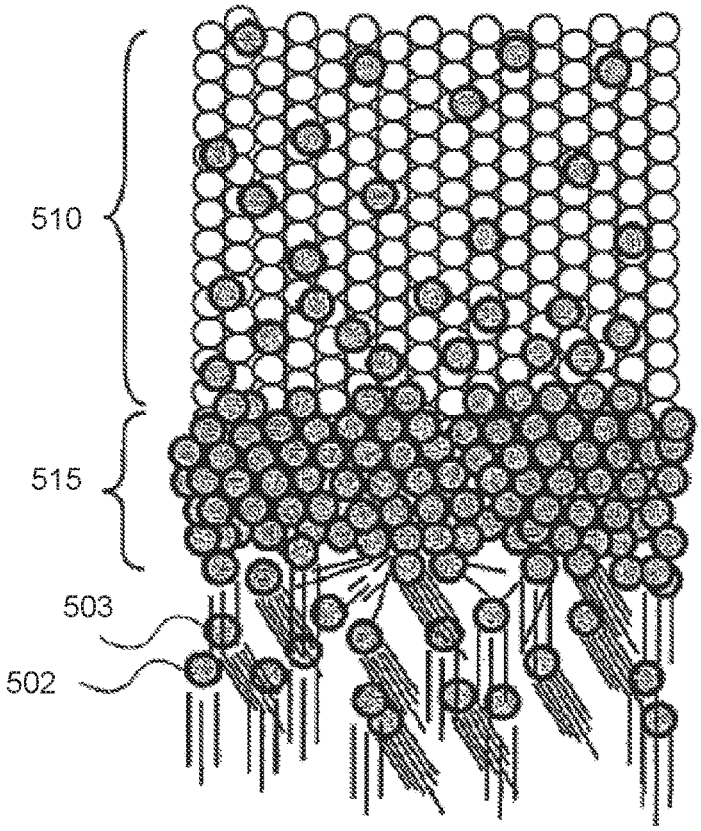
FIG. 5A depicts a deposition mechanism applicable to a variety of deposition techniques utilizing energetic particles such as ion assisted deposition (IAD).

FIG. 5A depicts a deposition mechanism applicable to a variety of deposition techniques utilizing energetic particles such as ion assisted deposition (IAD). Exemplary IAD methods include deposition processes which incorporate ion bombardment, such as evaporation (e.g., activated reactive evaporation (ARE)) and sputtering in the presence of ion bombardment to form plasma resistant coatings as described herein. Any of the IAD methods may be performed in the presence of a reactive gas species, such as $O_2$, $N_2$, halogens, etc.

As shown, a thin final plasma resistant coating layer 515 is formed by an accumulation of deposition materials 502 in the presence of energetic particles 503 such as ions. The deposition materials 502 include atoms, ions, radicals, or their mixture. The energetic particles 503 may impinge and compact the thin final plasma resistant coating layer 515 as it is formed.

Figure 5B:
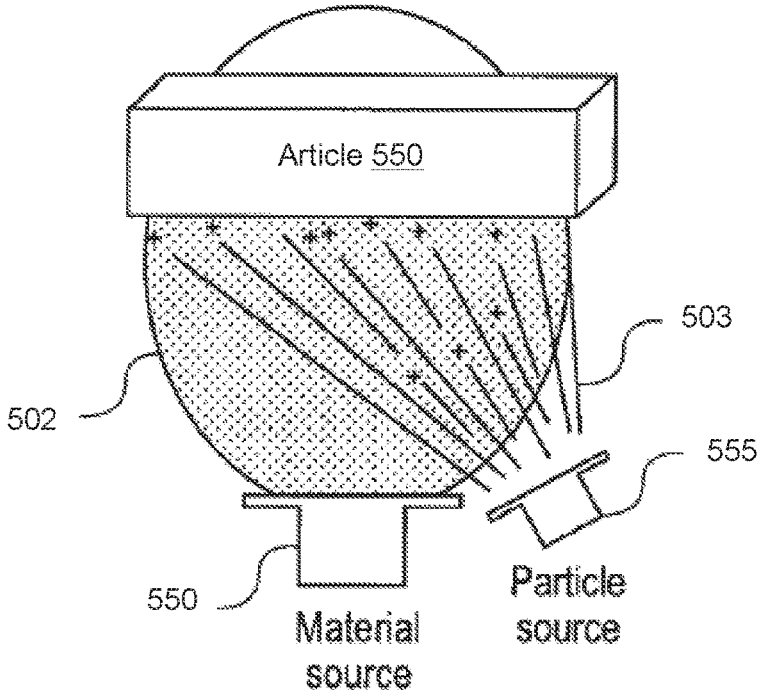
FIG. 5B depicts a schematic of an IAD deposition apparatus.

In one embodiment, IAD is utilized to form a thin final plasma resistant coating layer 515, as previously described elsewhere herein. FIG. 5B depicts a schematic of an IAD deposition apparatus. As shown, a material source 550 provides a flux of deposition materials 502 while an energetic particle source 555 provides a flux of the energetic particles 503, both of which impinge upon the material source 550 throughout the IAD process. The energetic particle source 555 may be an oxygen or other ion source. The energetic particle source 555 may also provide other types of energetic particles such as inert radicals, neutron atoms, and nano-sized particles which come from particle generation sources (e.g., from plasma, reactive gases or from the material source that provide the deposition materials). IAD may utilize one or more plasmas or beams to provide the material and energetic ion sources. Reactive species may also be provided during deposition of the plasma resistant coating.

With IAD processes, the energetic particles 503 may be controlled by the energetic ion (or other particle) source 555 independently of other deposition parameters. According to the energy (e.g., velocity), density and incident angle of the energetic ion flux, composition, structure, crystalline orientation and grain size of the thin film protective layer may be manipulated. Additional parameters that may be adjusted are a temperature of the article during deposition as well as the duration of the deposition. The ion energy may be roughly categorized into low energy ion assist and high energy ion assist. The ions are projected with a higher velocity with high energy ion assist than with low energy ion assist. In general superior performance has been shown with high energy ion assist. Substrate (article) temperature during deposition may be roughly divided into low temperature (around 120-150° C. in one embodiment which is typical room temperature) and high temperature (around 270° C. in one embodiment).

Figure 6:
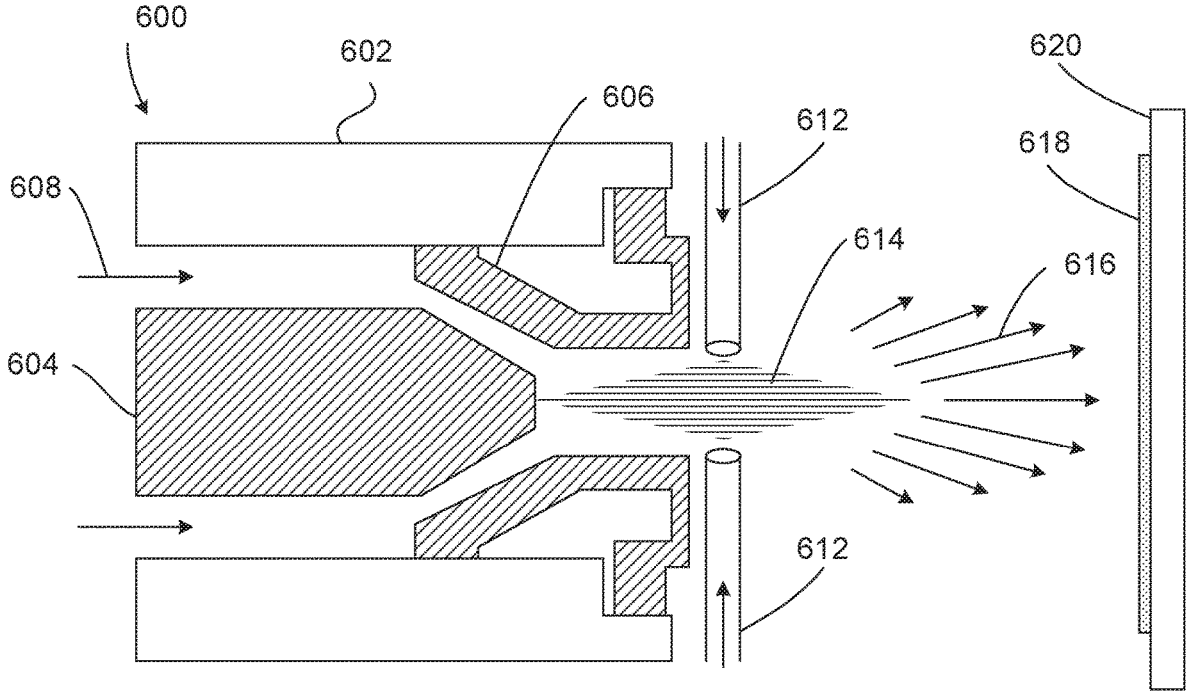
FIG. 6 depicts a sectional view of a plasma spray coating device.

FIG. 6 depicts a schematic of a plasma spray deposition apparatus 600 used for spray deposition techniques. The plasma spray apparatus 600 may include a casing 602 that encases a nozzle anode 606 and a cathode 604. The casing 602 permits gas flow 608 through the plasma spray device 600 and between the nozzle anode 606 and the cathode 604. An external power source may be used to apply a voltage potential between the nozzle anode 606 and the cathode 604. The voltage potential produces an arc between the nozzle anode 606 and the cathode 604 that ignites the gas flow 608 to produce a plasma gas. The ignited plasma gas flow 608 produces a high-velocity plasma plume 614 that is directed out of the nozzle anode 606 and toward an article 620.

The plasma spray apparatus 600 may be located in a chamber or atmospheric booth. In some embodiments, the gas flow 608 may be a gas or gas mixture including, but not limited to argon, nitrogen, hydrogen, helium, and combinations thereof. In some embodiments, wherein the spray system is used to perform slurry plasma spray, the plasma spray apparatus 600 may be equipped with one or more fluid lines 612 to deliver a slurry into the plasma plume 614. In some embodiments, a particle stream 616 is generated from plasma plume 614 and is propelled towards article 620. Upon impact with the article 620, the particle stream forms a final plasma resistant coating 618.

The preceding description sets forth numerous specific details such as examples of specific systems, components, methods, and so forth, in order to provide a good understanding of several embodiments of the present invention. It will be apparent to one skilled in the art, however, that at least some embodiments of the present invention may be practiced without these specific details. In other instances, well-known components or methods are not described in detail or are presented in simple block diagram format in order to avoid unnecessarily obscuring the present invention. Thus, the specific details set forth are merely exemplary. Particular implementations may vary from these exemplary details and still be contemplated to be within the scope of the present invention.

Reference throughout this specification to "one embodiment" or "an embodiment" means that a particular feature, structure, or characteristic described in connection with the embodiment is included in at least one embodiment. Thus, the appearances of the phrase "in one embodiment" or "in an embodiment" in various places throughout this specification are not necessarily all referring to the same embodiment. In addition, the term "or" is intended to mean an inclusive "or" rather than an exclusive "or." When the term "about" or "approximately" is used herein, this is intended to mean that the nominal value presented is precise within ±10%.

Although the operations of the methods herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent and/or alternating manner.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A method comprising:

identifying a coefficient of thermal expansion (CTE) of a component for a chamber of manufacturing equipment;

identifying the CTE of an initial plasma resistant coating material to be used for coating a surface of the component;

confirming that the CTE of the initial plasma resistant coating material is greater than the CTE of the component; and mixing the initial plasma resistant coating material with $ScF_3$ to form a final plasma resistant coating material having a tailored CTE, wherein the tailored CTE of the final plasma resistant coating material is within 20% of the CTE of the component.

2. The method of claim 1, further comprising coating the surface of the component using the final plasma resistant coating material.

3. The method of claim 1, wherein the final plasma resistant coating material comprises:

a first amount of the initial plasma resistant coating material; and a second amount of the $ScF_3$, wherein the $ScF_3$ is a plasma resistant negative CTE material.

4. The method of claim 1, wherein the initial plasma resistant coating material is selected from the group consisting of $YF_3$, $Y_2O_3$, a compound of $Y_4Al_2O_9$, a solid-solution of $Y_2O_3$—$ZrO_2$, $CaF_2$, $MgF_2$, $SrF_2$, $AlF_3$, $ErF_3$, $LaF_3$, $NdF_3$, $ScF_3$, $CeF_4$, $ZrF_4$, and combinations thereof.

5. The method of claim 1, wherein the component comprises one or more of Si, $SiO_2$, SiC, AlN, or $Al_2O_3$.

6. The method of claim 1, wherein the final plasma resistant coating material is a solid solution of the initial plasma resistant coating material and $ScF_3$.

7. The method of claim 3, wherein the first amount is 50% by volume and the second amount is 50% by volume, wherein the initial plasma resistant material is $YF_3$, and wherein the tailored CTE of the final plasma resistant material is about 3.5 ppm/K.

8. The method of claim 3, wherein the first amount is 65% by volume and the second amount is 35% by volume, wherein the initial plasma resistant material is $YF_3$, and wherein the tailored CTE of the final plasma resistant material is about 6.5 ppm/K.

9. The method of claim 3, wherein the first amount is 60% by volume and the second amount is 40% by volume, wherein the initial plasma resistant material is $Y_2O_3$, and wherein the tailored CTE of the final plasma resistant material is about 0.8 ppm/K.

10. A final plasma resistant coating material for a component for chamber manufacturing equipment, comprising:

a first amount of an initial plasma resistant coating material having a first coefficient of thermal expansion (CTE) greater than a CTE of the component; and a second amount of $ScF_3$, wherein the first amount of the initial plasma resistant coating material and the second amount of the $ScF_3$ causes the final plasma resistant coating material to have a CTE that is within 20% of the CTE of the component.

11. The final plasma resistant coating material of claim 10, wherein the initial plasma resistant coating material is selected from the group consisting of $YF_3$, $Y_2O_3$, a compound of $Y_4Al_2O_9$, a solid-solution of $Y_2O_3$—$ZrO_2$, $CaF_2$, $MgF_2$, $SrF_2$, $AlF_3$, $ErF_3$, $LaF_3$, $NdF_3$, $ScF_3$, $CeF_4$, $ZrF_4$, and combinations thereof.

12. The final plasma resistant coating material of claim 10, wherein the component comprises one or more of Si, $SiO_2$, SiC, AlN, or $Al_2O_3$.

13. The final coating material of claim 10, wherein the first amount is 50% by volume and the second amount is 50% by volume, wherein the initial plasma resistant material is $YF_3$, and wherein the tailored CTE of the final plasma resistant material is about 3.5 ppm/K.

14. The final coating material of claim 10, wherein the first amount is 65% by volume and the second amount is 35% by volume, wherein the initial plasma resistant material is $YF_3$, and wherein the tailored CTE of the final plasma resistant material is about 6.5 ppm/K.

15. The final coating material of claim 10, wherein the first amount is 60% by volume and the second amount is 40% by volume, wherein the initial plasma resistant material is $Y_2O_3$, and wherein the tailored CTE of the final plasma resistant material is about 0.8 ppm/K.

16. A coated article comprising:

a body having a CTE; and a final plasma resistant coating material having a tailored CTE, the final plasma resistance coating material comprising:

a first amount of an initial plasma resistant coating material having a first CTE greater than a CTE of the body; and a second amount of $ScF_3$, wherein at least one layer of the final plasma resistant coating material is coated onto at least one surface of the body, and wherein the first amount of the initial plasma resistant coating material and the second amount of the $ScF_3$ causes the tailored CTE that is within 20% of the CTE of the body.

17. The coated article of claim 16, wherein the coated article comprises substrate support assembly, an electrostatic chuck, a process kit ring, a single ring, a chamber wall, a base, a gas distribution plate, a showerhead, a nozzle, a liner, a liner kit, a shield, a plasma screen, a flow equalizer, a cooling base, a chamber viewport, or a chamber lid.

18. The coated article of claim 16, wherein the initial plasma resistant coating material is selected from the group consisting of $YF_3$, $Y_2O_3$, a compound of $Y_4Al_2O_9$, a solid-solution of $Y_2O_3$—$ZrO_2$, $CaF_2$, $MgF_2$, $SrF_2$, $AlF_3$, $ErF_3$, $LaF_3$, $NdF_3$, $ScF_3$, $CeF_4$, $ZrF_4$, and combinations thereof.

19. The coated article of claim 16, wherein the body comprises one or more of Si, $SiO_2$, SiC, AlN, or $Al_2O_3$.

20. The coated article of claim 16, wherein the final plasma resistant coating material is a solid solution of the initial plasma resistant coating material and $ScF_3$.

* * * * *